US010653578B2

(12) United States Patent
Hsieh

(10) Patent No.: US 10,653,578 B2
(45) Date of Patent: May 19, 2020

(54) GUS CUSHION ANKLE HOLDER FOR AN INVERSION TABLE

(71) Applicant: Paul Hsieh, City of Industry, CA (US)

(72) Inventor: Paul Hsieh, City of Industry, CA (US)

(73) Assignee: Paradigm Health & Wellness, Inc., City of Industry ( * ) Notice: Subject to any disclaimer, the term of this patent is extended or adjusted under 35 U.S.C. 154(b) by 121 days.

(21) Appl. No.: 15/969,688

(22) Filed: May 2, 2018

(65) Prior Publication Data

US 2018/0338879 A1 Nov. 29, 2018

Related U.S. Application Data

(60) Provisional application No. 62/510,205, filed on May 23, 2017.

(51) Int. Cl.
*A61H 1/02* (2006.01)
*A61H 1/00* (2006.01)

(52) U.S. Cl.
CPC ..... *A61H 1/0229* (2013.01); *A61H 1/003* (2013.01); *A61H 2201/0103* (2013.01); (Continued)

(58) Field of Classification Search
CPC ..... A61F 5/0111; A61F 5/012; A61F 5/0127; A61F 5/0195; A61H 2201/0134; A61H 2201/0138; A61H 2201/0142; A61H 2201/0149; A61H 2201/1619; A61H 2201/1626; A61H 2201/1623; A61H 2201/1676; A61H 2201/1253; A61H 2201/0192; A61H 2203/0481; A61H 2203/0487; A61H 2203/0493; A61H 2203/04; A61H 1/0229; A61H 1/0292; (Continued)

(56) References Cited

U.S. PATENT DOCUMENTS 3,568,669 A 3/1971 Stites
4,367,731 A 1/1983 Barber
(Continued)

OTHER PUBLICATIONS (Teeter) EP 560, YouTube Video, "https://www.youtube.com/watch?v=UEyi06Zzfvs" Jan. 6, 2014 (Year: 2014).*

*Primary Examiner* — Loan B Jimenez
*Assistant Examiner* — Zachary T Moore
(74) *Attorney, Agent, or Firm* — Kirk A Buhler; Buhler & Associates Patenting

(57) ABSTRACT

Improvements to an ankle holder for an inversion table. The ankle holders are formed of an elastomeric material that is molded onto a rigid backing. The elastomeric material is sufficient durometer to easily conform to the shape of ankles. The backing is secured to a pivoting structure. The ankle holder has a pre-formed shape that approximates the shape and contour of an ankle/heel/foot. The ankle holder can expand and move around the shape of the person to evenly distribute forces caused by inversion of the table. The ankle holders can include a plurality of bladders on the backing to provide structural support to the bladders that enables the bladders to be mounted and secured onto the inversion table. The distance between the gas cushions is adjustable to allow a user to place their ankles within the inversion table and customize the clamping forces.

20 Claims, 7 Drawing Sheets

(52) U.S. Cl.
CPC ..... *A61H 2201/1642* (2013.01); *A61H 2203/0493* (2013.01); *A61H 2205/081* (2013.01)

(58) Field of Classification Search
CPC ..... A63B 23/0205; A63B 23/0233; A63B 23/0211; A63B 23/0222; A63B 23/0254; A63B 2023/006; A63B 21/00047; A63B 21/00185; A63B 21/4029; A63B 21/068; B60N 2/58; B60N 2/60; A61G 13/122; A61G 13/04; A61G 13/009; A61G 13/125
USPC ..... 602/13; 482/144, 145
See application file for complete search history.

(56) References Cited

U.S. PATENT DOCUMENTS 4,444,178 A 4/1984 Kuo
4,494,532 A 1/1985 Masuda et al.
4,620,698 A * 11/1986 Reed ..... A61G 13/12 5/624
4,624,458 A * 11/1986 Fendrik ..... A61H 1/0218 482/144
5,551,937 A 9/1996 Kwo
5,730,136 A * 3/1998 Laufer ..... A61B 5/02007 600/454
5,839,138 A * 11/1998 Weidman ..... A47G 9/10 5/636
6,306,112 B2 10/2001 Bird
6,695,754 B1 2/2004 Gazzolo
6,814,691 B1 11/2004 Kuo
7,077,795 B2 7/2006 Chen
7,081,073 B1 7/2006 Smith
7,399,260 B1 * 7/2008 Chen ..... A61H 1/0218 403/109.3
9,089,468 B2 7/2015 Wang
2003/0153442 A1 8/2003 Kuo
2003/0162639 A1 8/2003 Hsien
2006/0030466 A1 * 2/2006 Chen ..... A61H 1/0218 482/145

* cited by examiner

GUS CUSHION ANKLE HOLDER FOR AN INVERSION TABLE

CROSS REFERENCE TO RELATED APPLICATIONS

This application claims the benefit of Provisional Application Ser. No. 62/510,205 filed May 23, 2017 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an ankle holder. More particularly, the present gas cushioned ankle holder provides a cushion for an ankle holder used on an inversion table to spread the load on the ankles of a user when a user is on an inversion table in a partially or fully inverted orientation.

Description of Related Art Including Information Disclosed Under 37 CFR 1.97 and 1.98

Inversion tables have been used for many years by people to reduce back pain and to stretch the spine. Inversion tables are essentially beds, tables or a cloth covered frame. The table is secured to a frame across the narrow mid-section of the table to allow the table to pivot across the mid-section. At one end of the table is a retention mechanism for securing the ankles of the user. One problem with inversion tables is the discomfort from force concentration points that are caused on the ankles when the person in inverted, or at least partially inverted. The design of the ankle/foot restraints must provide cushioning and be able to accommodate a wide variety of different size and shape ankles and feet.

A number of patents and or publications have been made to address these issues. Exemplary examples of patents and or publication that try to address this/these problem(s) are identified and discussed below.

U.S. Pat. No. 3,568,669 issued on Mar. 9, 1971 to Joseph D. Stites is titled Tilting Health Table. This patent discloses a tiltable health table apparatus having a table which is rotatively mounted on a framework, with the table being connected to the framework at a point on the table which will produce an axis of rotation extending across the width of the table. The leg restraint is a pair of cushioned ankle clamps. The ankle clamps are essentially contoured members that are cushioned to spread the loading. While the ankle clamps are cushioned, they can still have concentration points on people who have ankles that are larger or smaller than the contoured members.

U.S. Pat. No. 5,551,937 issued on Sep. 3, 1996 to Chung-Jen Kwo is titled Body Inversion Suspension Exercise Device. This patent discloses an exercise device comprises a frame, a backrest set and a leg pressing rod. The leg pressing rod comprises a height adjusting rod to which two rest pads, one pedal and one operating rod are fastened pivotally. The operating rod is provided at the lower segment thereof with another two rest pads and at the upper segment thereof with a plurality of projections spaced equidistantly. The leg press rods are essentially cushioned cylinders that do not provide any contouring to the ankles.

U.S. Pat. No. 6,306,112 issued on Oct. 23, 2001 to John R. Bird is titled Bladder for Orthopedic Supports. This patent disclosed a therapeutic ankle support brace bladder pad member having a pair opposed surfaces defining an inflated gas support pocket and a second support pocket containing gel material and filler apparatus materials. The orthopedic support is configured to fit within the sides of a leg brace to spread the support forces, it is not configured to fit on the top of the foot and the back of the foot in an inversion table.

What is needed is an ankle holder that uses contoured gas-filled bladders to evenly distribute load on the feet/ankles of a user. The proposed gas-filled cushioned ankle holder for an inversion table in this document provides the solution.

BRIEF SUMMARY OF THE INVENTION

It is an object of the gas cushioned ankle holder for an inversion table to provide a cushion to the ankles with gas-filled bladders. The gas-filled bladder(s) evenly distribute forces to all areas of the ankle that are in contact with the gas bladders. The bladders can have a neutral gas pressure or can be filled with some pressure to provide some initial expansion. The gas-filled bladders could further be covered with a gel pad, removable fabric or have other treatment for comfort or for hygienic purposes.

It is an object of the gas cushioned ankle holder for an inversion table for the gas cushions to have a pre-formed shape that approximates the shape and contour of an ankle/heel/foot. The contour provides an initial shape. While the contour may not approximate all people, the bladder can expand and move around the shape of the person to evenly distribute the forces. Because the cushions are filled with air or gas, a person can move or rotate their ankles slightly when secured to locate a preferred position as the cushions continuously distribute the forces due to the even pressure within the gas-filled bladders.

It is another object of the gas cushioned ankle holder for an inversion table for the gas cushions to be secured to a rigid back plate. The rigid back plate provides a structural support to the bladders to enable the bladders to be mounted to the inversion table. Without the structural support the shape and position of the bladders can become unstable and can move.

It is still another object of the gas cushioned ankle holder for an inversion table for the distance between the gas cushions to be adjustable. The adjustment of the distance between the gas cushions allows a user to place their ankles within the inversion table and customize the clamping forces. The amount of clamping forces allows the gas cushions to spread and wrap around the ankles. The amount of clamping pressure can further be adjusted for comfort or pressure on the user. The clamps are opened to allow the user to exit the inversions table.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
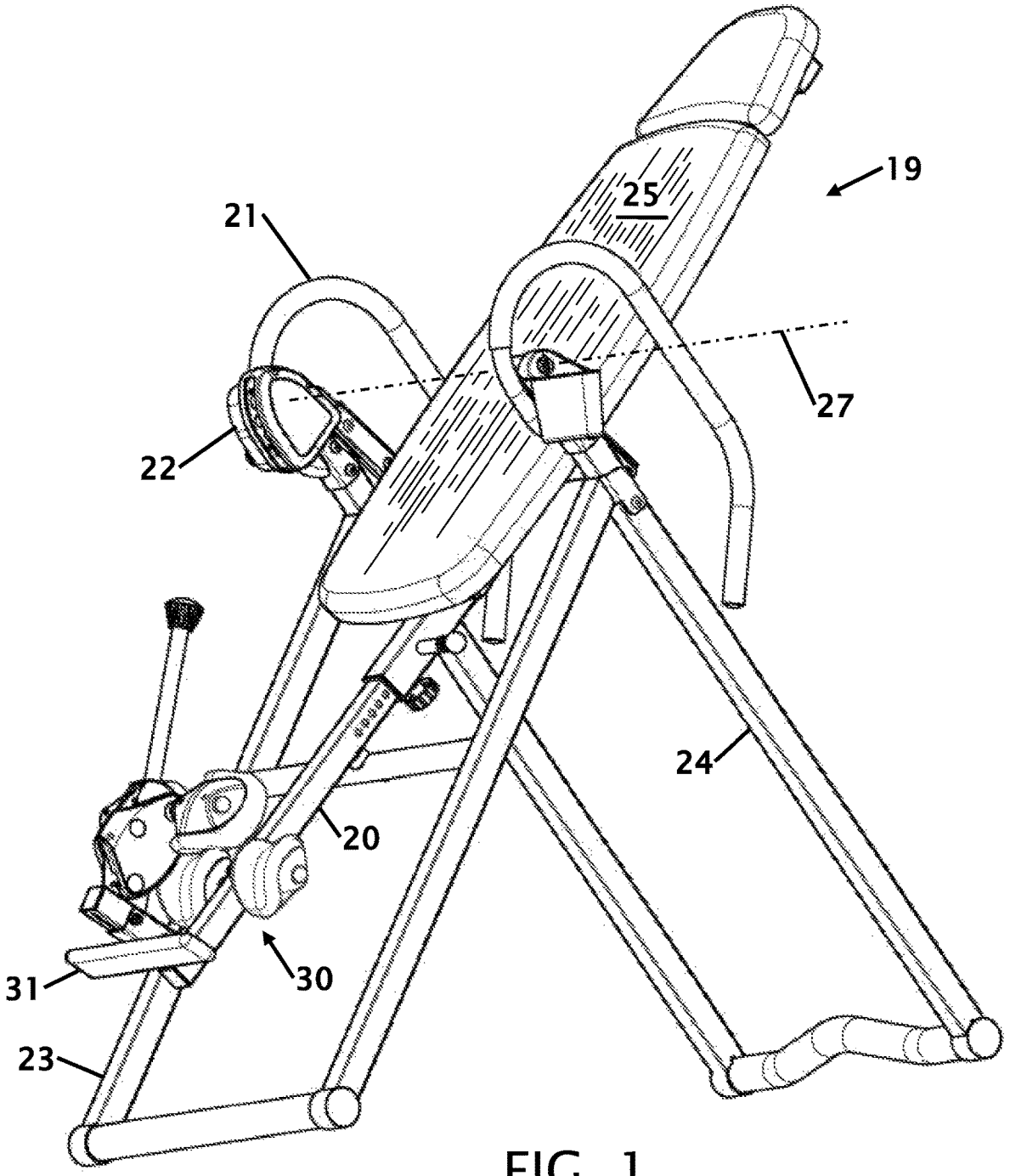
FIG. 1 shows a perspective view of an inversion table with the gas cushioned ankle holders.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

ITEM NUMBERS AND DESCRIPTION

18 cosmetic skin, fabric or other over coating
19 inversion table
20 elongated post/length adjustment tube
21 side tubes
22 pin cover
23 extended leg
24 extended leg
25 inversion table or bed
27 balance axis
29 tube
30 ankle securing mechanism or holders
31 foot pad, foot rest, support
32 tube
33 opening and closing ratchet mechanism
34 moving cross tube or pipe
35 cross tube or pipe
36 rod
37 fastener(s)
38 slotted hole
39 cord ends
40 bottom
40L/40R bottom gas filled cushions
41L/41R gas-filled cushion
42L/42R ankle cup covers
43L/43R hole
44L/44R gas-filled cushion sides
46 gas-filled blocks
47 backing
48 plate
49 openings
50 top
50L/50R top gas-filled cushions
51L/51R gas-filled cushion
52 ankle cup cover
53R/53L hole
54L/54R gas-filled cushion sides
55 structural support tube
56 structural frame rib
57 bonded
58 cord or string
59 composite support shell or structural support frame
63 fastener
64 elongated hole
65 structural support tube
67 ribs FIG. 1 shows a perspective view of an inversion table 19 with the gas cushioned ankle holders 30 with the ankle holding mechanism in the closed or clamped orientation. In this figure, the inversion table surface 25 is shown in an initial orientation. The inversion table 25 rotates on pivots within the balance axis 27. The inversion table 25 is supported on open or extended legs 23 and 24 that can be hinged together to reduce the storage size of the inversion table 19. Side tubes 21 allow a person to incline and decline the inversion bed 25 on the pivot or balance axis.

The ankle holding mechanism 30 is located on an elongated post 20 that is adjustably secured in the bottom of the table 25. The elongated post 20 is adjustable to locate a balance point that is unique for people having different heights and body mass distribution. In this orientation, a user can enter the inversion table 19, open the ankle holder 30, insert their legs into the ankle holders 30 while they stand on the foot pad 31. A pin cover 22 covers a mechanism that limits the amount of rotation of the inversion table or bed 25.

Figure 2:
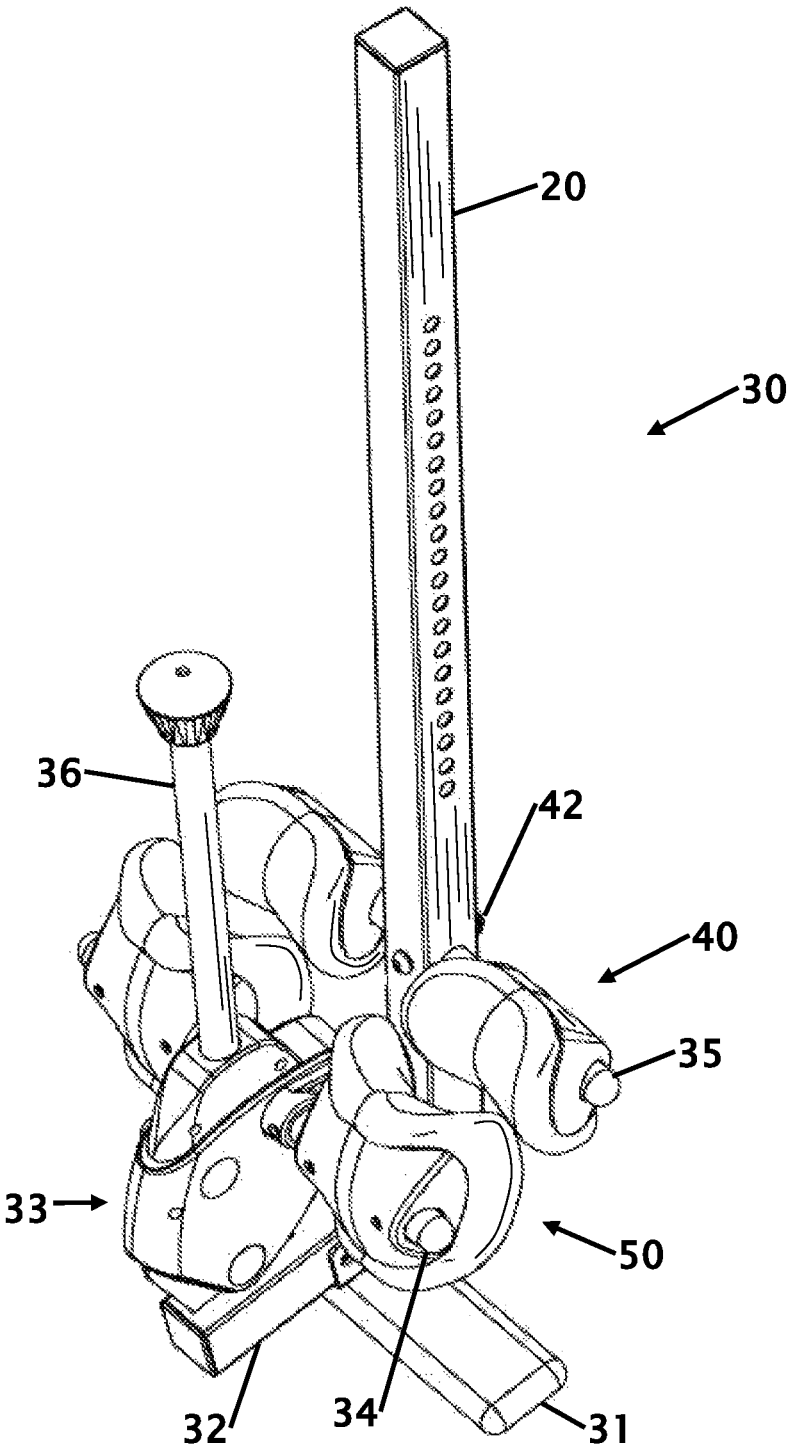
FIG. 2 shows a perspective view of the ankle securing mechanism with the gas cushioned ankle holders.

FIG. 2 shows a perspective view of the ankle securing mechanism 30 with the gas cushioned ankle holders. The ankle holders are complementary top 50 and bottom 40 components that are located on the left and right side of the length adjustment tube 20. A rod 36 pivots on the end of the length adjustment tube 20 to move the top 50 gas filled cushions away from the bottom 40 gas filled cushions. The top gas-filled cushion(s) 50 connect to a moving cross tube or pipe 34 and can pivot on the cross tube or pipe 34 to accommodate angular orientation of the ankles within the gas-filled cushion(s) 50. The bottom gas filled cushion(s) 40 are connected to a similar cross pipe 35 and the gas-filled cushion(s) 40 can pivot on the cross pipe 35. While top gas-filled cushion(s) 50 are secured to the top to the foot and bottom gas-filled cushion(s) 40 are used to cushion the back or heel of an ankle, it should be understood that each of the gas-filled cushion(s) 40 and 50 can be modified to accommodate different body sizes and parts without departing from the inventive nature of the gas-filled ankle holders.

While the cross tube 34 is secured to the top gas-filled cushions 50 to the opening and closing ratchet mechanism 33, the cross tube 35 is secured 42 to the length adjustment tube 20. The foot rest or support 31 is secured to the end of the length adjustment tube 20 to provide a platform that moves with the inversion table. The closing mechanism 33 is secured on tube 32 that is secured to the length adjustment tube 20 and the foot rest or support 31. The closing mechanism 33 is controlled with a control tube or rod 36 that can be opened and closed by a user to open, close the gas-filled pad groups 40 and 50 to allow a person to be secured in the inversion table in an inverted orientation. The opening and closing moves the pair of top 50 gas-filled cushion(s) relative to a fixed pair of stationary bottom 40 heel cups.

Figure 3:
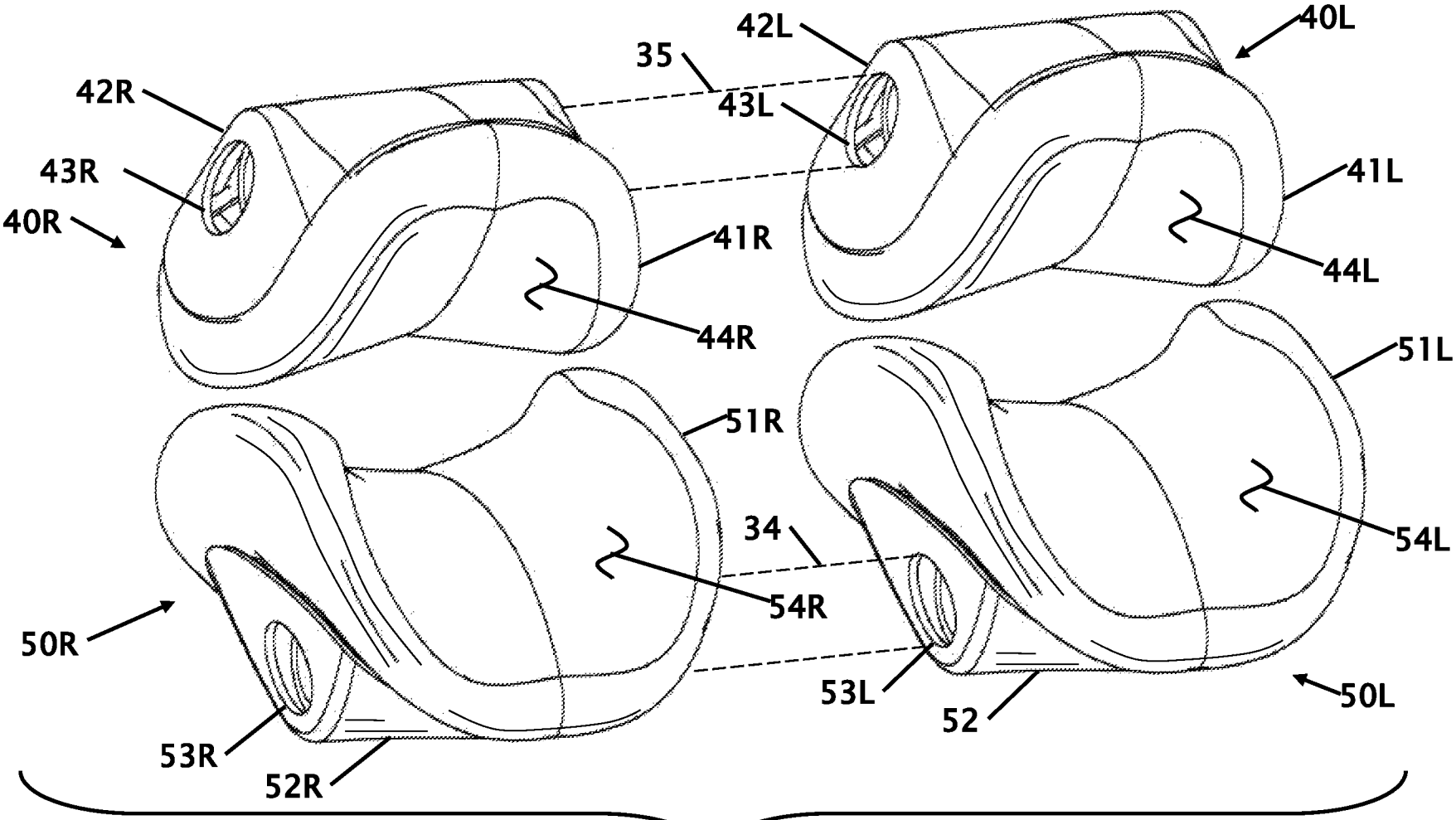
FIG. 3 shows a perspective view of the gas cushioned ankle holders.

FIG. 3 shows a perspective view of the gas cushioned ankle holders 40L, 40R, 50L and 50R. In this figure, the top gas-filled cushions 50L, 50R would be used to secure the top of the ankles, while the bottom gas-filled cushions 40L, 40R would be used to secure the rear or heel of the foot or ankle. The left side gas-filled cushions are designated as 40L and 50L, while the right-side gas-filled cushions are designated as 40R and 50R.

Each gas-filled cushion 40L, 40R, 50L and 50R has a bladder with a front surface or contact surface 44L, 44RA, 54L and 54R that contacts a portion of the ankle of the user of the inversion table. The sides 41L, 41R, 51L and 51R of the gas-filled cushions and the structural frame 59 supports the load of the user when the user is suspended in an inverted orientation. Each of the gas-filled cushions 40L, 40R, 50L and 50R are further secured to an ankle cup cover 42L, 42R, 52L and 52R where the gas-filled cushions are secured with a cross-tube (not shown in this figure).

Each of the ankle cup covers 42L, 42R, 52L and 52R has a hole 43R, 43L, 53R and 53L where the cross pipes 34 and 35 are placed. Each of the gas-filled cushions can independently pivot (slightly) on their respective cross-pipe or tube 34 and 35. The independent pivoting allows for angular alignment of the gas-filled cushions with the inversion table bed.

In another contemplated embodiment the bottom or rear heel 40L and 40R can be formed from a composite elastomeric material without gas bladders to provide a more solid anchor to the retained ankles, while the top heel holder 50L and 50R remain gas-filled to provide a better force distribution to the top of the captured ankles.

Figure 4:
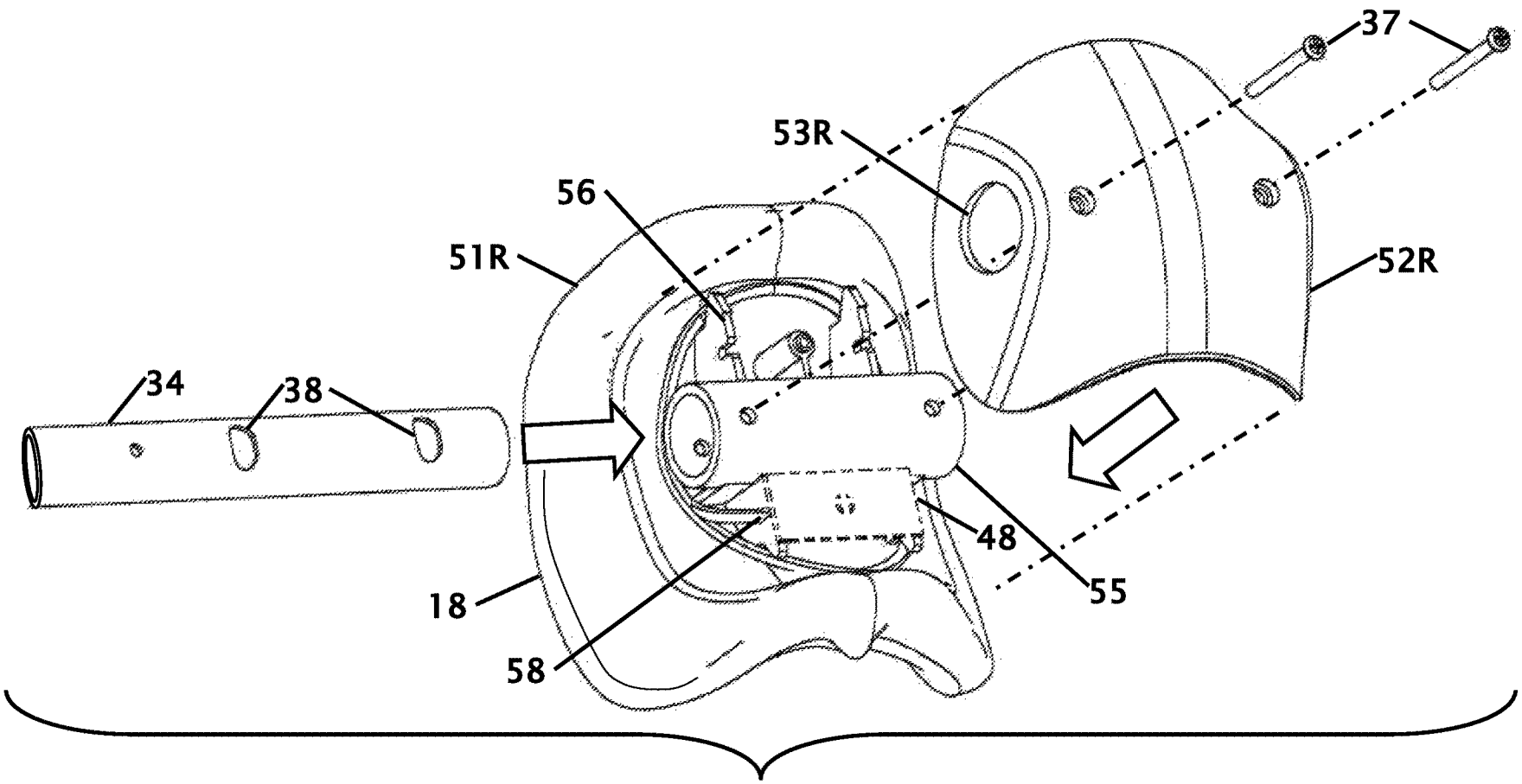
FIG. 4 shows a separated view of one gas cushion.

FIG. 4 shows a separated view of one gas cushion. While only one gas-filled cushion is shown, and described in the following figures, it should be understood that same or similar embodiment is utilized in the remaining gas-filled cushions. The front of the gas-filled cushion makes contact with the ankles of the user and is shown and described in more detail in FIGS. 6 and 7 herein. The front of the gas-filled cushion is contoured to approximate the desired end shape as the gas-filled cushion contours around the ankle of the user. The material of the gas-filled cushion is selected to provide the desired structural rigidity as well as flexibility to mold around the ankles of a user.

In the preferred embodiment, the gas-filled cushion is polyurethane, rubber, silicon or other equivalent material. The user contact area of the gas-filled cushions has a cosmetic skin of fabric or other over coating 18 that is stretched over the gas-filled pads. The fabric cover may further include a gel pack or memory foam to further spread and distribute retention forces. The cover breaths to reduce sweating or bacterial growth and can be replaced or washed as needed. The fabric cover 18 is secured over the gas-filled cushions with a cord or string 58 that is retained in a sleeve in the fabric cover 18. The ends of the cord or string 58 are secured with a plate 48 that prevents the cord from loosening. It is also contemplated that a sacrificial cover can be used that can be discarded or cleaned for each user.

The assembly starts with the gas-filled cushion 51R, 52L. With the ankle cup cover 52 removed from the back of the gas-filled cushion 51R, 52L shows a support tube 55 on a structural support frame rib 56. The support frame rib 56 with the support tube 55 is essentially a molded frame with threads or a threaded insert that accepts the fasteners 37. The ankle cup cover 52 has side holes 53 for the cross pipe or tube 34 to pass through the ankle cup cover 52 holes 53 and into the support tube 55 on structural support frame rib 56. The fasteners 37 pass through the ankle cup cover 52, through the holes in the support tube 55, through the slotted holes 38 in the cross pipe or tube 34 where the fasteners 37 are secured in the structural support frame rib 56.

The slotted holes 38 in the cross pipe or tube 34 allows the gas-filled cushion 51 to rotate on the cross pipe or tube 34 for alignment of the gas-filled cushion 51 with the ankles of a user. The slotted holes 38 provide limited rotational movement of the gas-filled cushions 51, and each gas-filled cushion can independently move or rotate on the cross pipe or tube 34.

Figure 5:
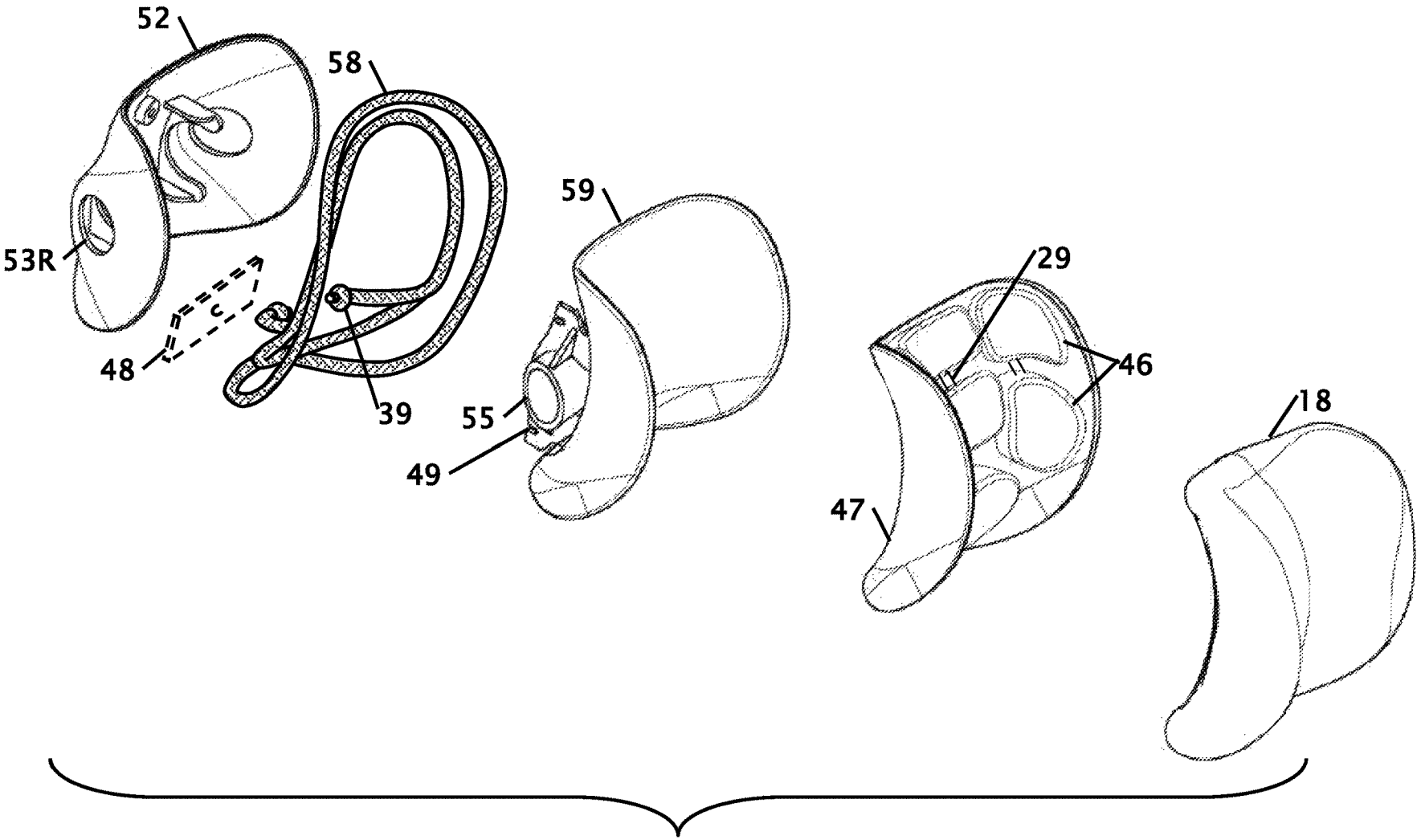
FIG. 5 shows an exploded view of one gas cushion.

FIG. 5 show an exploded view of one gas cushion. The gas cushion is shown as an array of gas-filled blocks 46 secured or bonded to a backing 47. The backing 47 is flexible to allow the array of gas-filled blocks 46 to bend on the backing 47 to contour to the support shell or structural frame 59. The gas-filled blocks 46 may be interconnected 29 with a tube, a plurality of tubes or a tube network to allow for inter-chamber gas flow. The gas-filled blocks 46 can also be individually sealed to provide a consistent force in every block 46. The compressed gas-filled blocks or bladders 46 on the flexible backing 47 are set into the support shell 59 or placed into the cosmetic skin or cover 18. The cover 18 is placed over the front of the compressed gas-filled blocks or bladders 46 and around the sides of the flexible backing 47. A cord 58 is integrated with the cover 18 or is loosely retained in a sleeve. The cord 58 draws the sides of the cover around the compressed gas-filled blocks 46, backing 47 and the support shell 59. The cord ends 39 are secured in openings 49 in the support shell 59. The cord ends 39 are secured with a plate 48 that locks the cord ends 39 in the support shell 59. The cup cover 52 encloses the internal components, leaving holes 53 and support tube 55 clear for the moving cross tube 34 (not shown in this figure).

Figure 6:
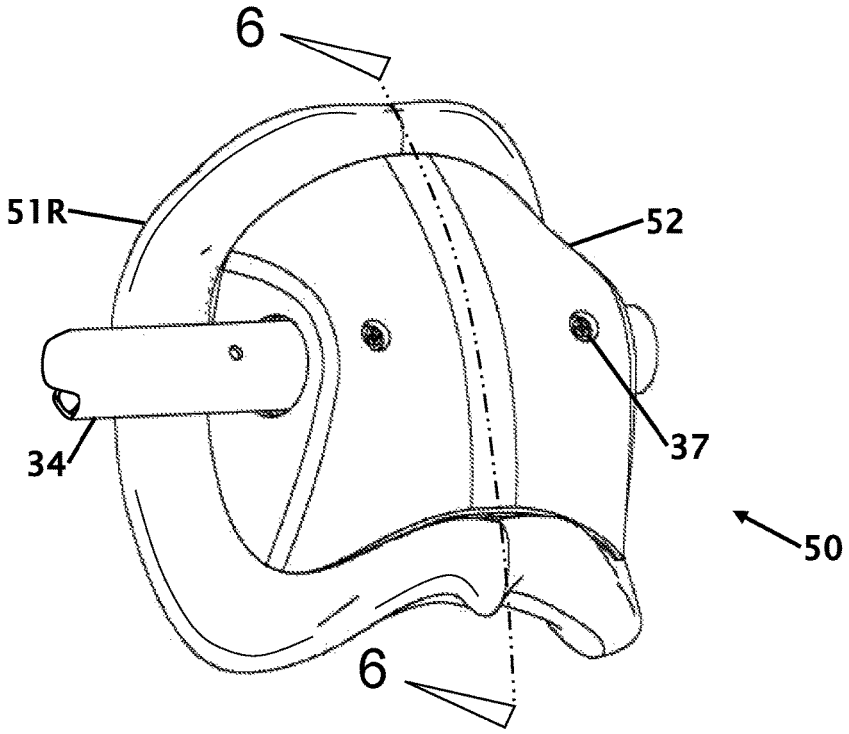
FIG. 6 shows an assembled view of the gas cushion shown in FIG. 4.

FIG. 6 shows an assembled view of the gas cushion 50 shown in FIG. 4. This assembly shows the cross pipe or tube 34 passing into the ankle cup cover 52. Fasteners 37 secure the ankle cup cover 52 to the gas-filled cushion 51. The contour of the gas-filled cushion 51 can be seen in this figure as the gas-filled bladder curves to accommodate an ankle of a user.

Figure 7:
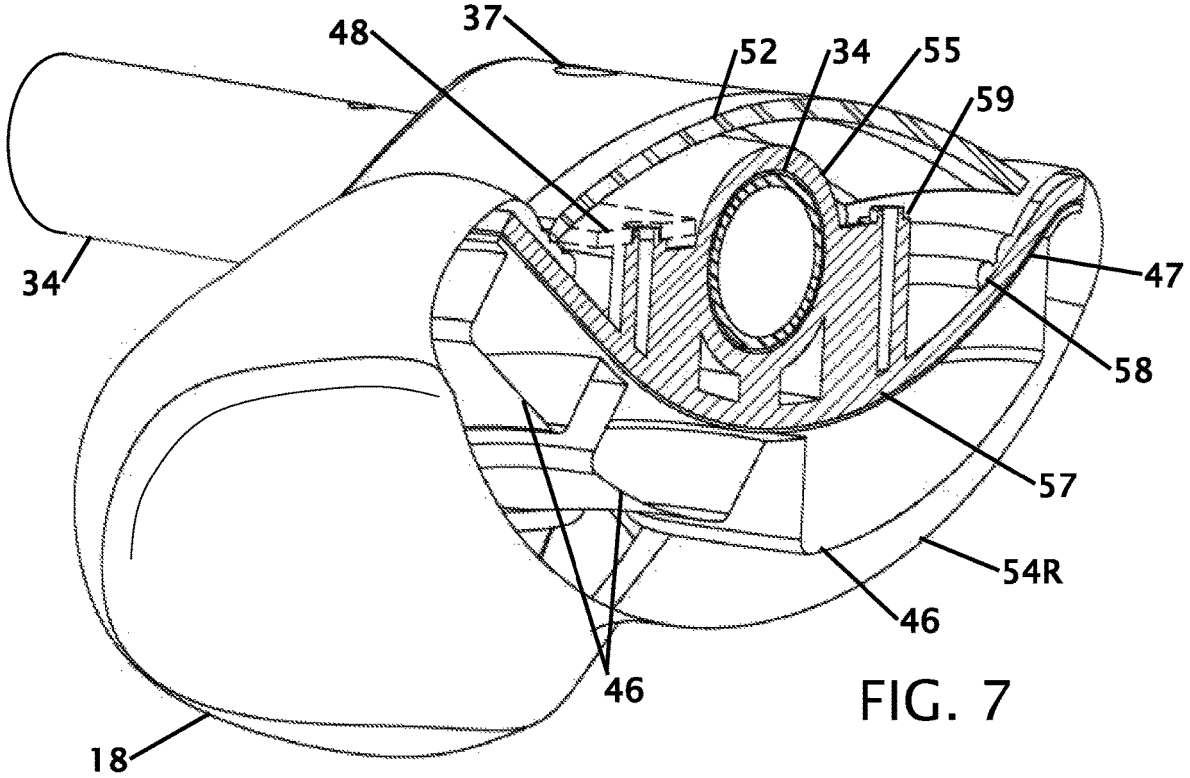
FIG. 7 shows a cross-sectional view of the gas cushion shown in FIG. 6.

FIG. 7 shows a cross-sectional view of the gas cushion shown in FIG. 6. This figure shows the cross pipe or tube 34 passing through the assembly. The cross pipe or tube 34 is secured to the assembly with fasteners 37 (only one shown). The cross pipe or tube 34 is shown passing through the ankle cup cover 52 where it is secured to the support tube 55 that is integrated with the back of the structural support frame 59. The structural support shell 59 has a plurality of walls and ribs. The gas-filled pockets or bladder(s) 46 of the contact surface of the gas-filled cushion sides 54 are secured with the cord 58 to the structural support shell 59 where the ends of the cord 58 are secured under the plate 48. In some embodiments the plate 48 may not be required and the cord is held with a knot or friction in the slot 49. The plurality of individual gas-filled pockets 46 provide some structural support for retaining an ankle in position on the inversion table. The cover 18 encloses the plurality of individual gas-filled pockets or blocks 46.

The plurality of individual-gas filled pockets or blocks 46 are shown filled with gas, but can be filled with other gasses, gel or foam that provides retention of the ankles to the gas-filled cushion and then to the frame of the inversion table. The pressure within the pockets 46 is selected to provide both a cushion and structural support. The pockets 46 are molded, bonded 57, sealed, enclosed or otherwise secured to the backing 47. In another contemplated embodiment the cosmetic skin 18 is a "sock" where the gas-filled pockets 46 are inserted into the cosmetic skin 18 sock and the cosmetic skin 18 has an integrated cord or string 58 that pulls around the support shell or structural frame 59 to retain the gas-filled pockets 46 and the cosmetic skin 18 onto the support shell or structural support fame 59.

The gas-filled cushion or pockets 46 can have a neutral internal pressure or can be pre-filled with ambient air, oxygen, argon, noble gas, nitrogen or other gas to have an internal pressure of 1 to 3 ATM. Filling the pockets 46 with a pressure of at least 1 ATM at sea level prevents shrinking of the pockets 46 at lower temperatures or elevations. Each of the gas-filled cushion can be filled with the same pressure or each of the gas-filled cushion can be filled with different pressures based upon a position of the gas-filled cushion in the cushioned ankle holder. For example, gas-filled cushions on the sides of the ankles may be different from the pressure on the top of the ankle holder.

Figure 8:
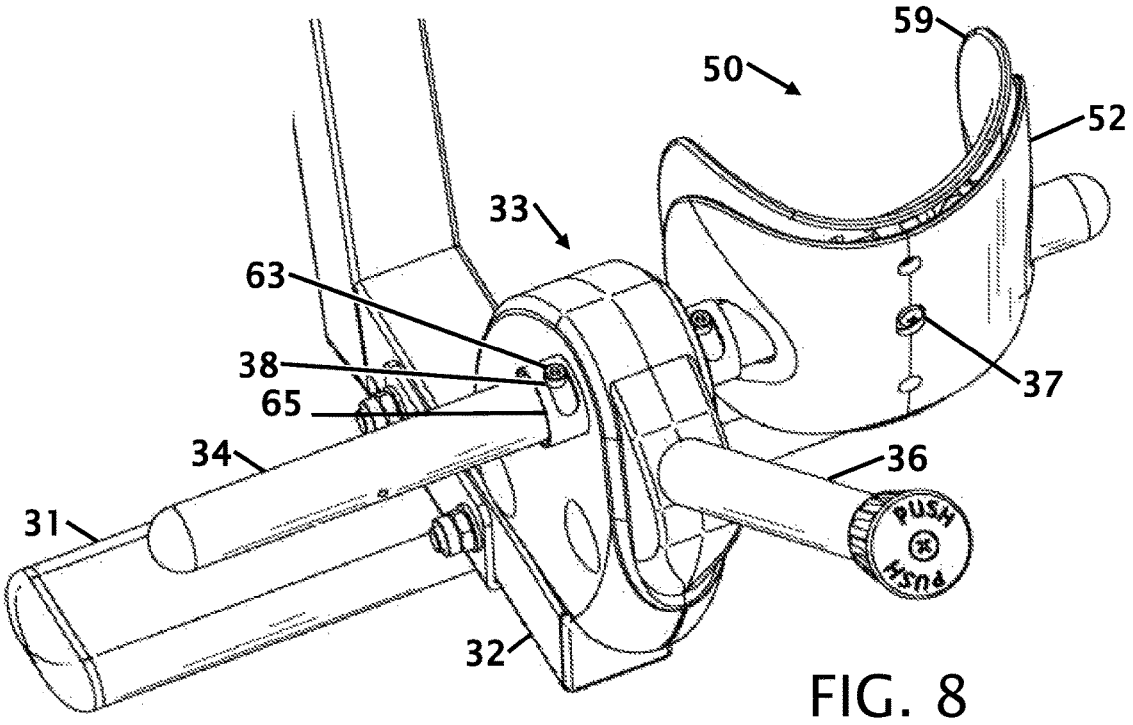
FIG. 8 shows an alternate embodiment of the ankle cushions

FIG. 8 shows an alternate embodiment of the ankle cushions top 50. While only a top of the left ankle is shown and described, it should be understood that the structure applies to the remaining ankle clamping/supporting members. In this figure the other three ankle cups have been removed for clarity. The majority of the components are similar with the foot support 31 where the use can stand. The foot support 31 is connected to the tube 32 that supports the opening and closing ratchet mechanism 33 with the control rod 36. In this embodiment the slotted hole 38 is retained with fastener 63 outside of the ankle support. The cross-tube pivots on a structural support tube 65 that has limited movement in the slotted hole 38.

This embodiment allows the ankle holders to be rigidly retained on the moving cross tube or pipe 34, and the moving cross tube or pipe 34 can axially turn within the ratchet mechanism 33 within the confines of the slotted hole 38. The ankle support is secured to the moving cross tube or pipe 34 with fastener 37. This figure also shows a composite support shell 59 that is covered with an ankle cup cover 52. The ankle cup cover provides a cosmetic backing and protects the interior features. Because the ankle cushion is composite, the skin cover, cord and cord retaining plate is not required.

Figure 9:
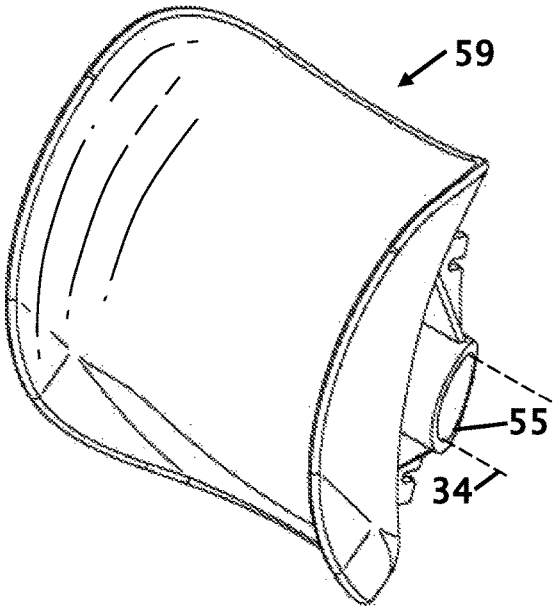
FIG. 9 shows a first perspective embodiment of a composite ankle cushion.
Figure 10:
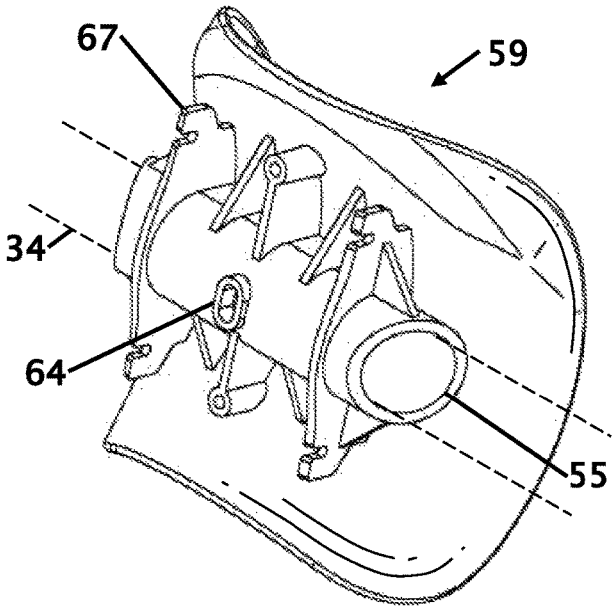
FIG. 10 shows a second first perspective embodiment of a composite ankle cushion.

FIG. 9 shows a first perspective embodiment of a composite support shell 59 and FIG. 10 shows a second first perspective embodiment of a composite support shell 59. The composite support shell 59 is a semi-ridged but flexible component with the rear structural components integrated into the composite support shell 59 cushion. The rear of the composite support shell 59 is secured or bonded to a more rigid backing 47. The backing 47 has a clearance for a structural support tube 55 hole for the moving cross tube or pipe 34. A fastener passes through an elongated hole 64 and into the moving cross tube or pipe 34. In FIG. 10 the structural ribs 67 are show to add support to the composite support shell 59. The ribs 67 further provides spacing and support for an ankle cup cover that covers the back of the gas-filled blocks and includes holes for the cross tube to pass through the ankle cup cover.

Thus, specific embodiments of a gas cushioned ankle holder for an inversion table have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A cushioned ankle holder for an inversion table comprising:

at least one gas-filled bladder that is connected to a flexible backing;

said flexible backing being configured to contour to a structural support frame;

a cosmetic skin that covers said at least one gas-filled bladder;

said cosmetic skin has a cord or string that is captured within a peripheral sleeve of said cosmetic skin;

said cord or string is a draw string that is configured to gather said cosmetic skin around said at least one gas-filled bladder and said structural support frame, wherein said structural support frame includes at least one slot that captures said cord or string, wherein the cord or string is held within the slot by friction;

said structural support frame is connected to an opening and closing ratcheting mechanism whereby said opening and closing mechanism is configured to retain an ankle of a person, and said opening and closing mechanism is secured to an inversion table.

2. The cushioned ankle holder for an inversion table according to claim 1, wherein said at least one gas-filled bladder includes a tube whereby gas is transferrable between at least two gas-filled bladders.

3. The cushioned ankle holder for an inversion table according to claim 1, wherein said at least one gas-filled bladder has an internal pressure of 1 to 3 atmospheres (ATM).

4. The cushioned ankle holder for an inversion table according to claim 1, wherein said gas is ambient air, oxygen, argon, noble gas or nitrogen.

5. The cushioned ankle holder for an inversion table according to claim 1, wherein there are at least three gas-filled bladders that are configured to cover two sides and a top of an ankle.

6. The cushioned ankle holder for an inversion table according to claim 1, wherein there are at least 7 gas-filled bladders.

7. The cushioned ankle holder for an inversion table according to claim 5, wherein each of said at least three gas-filled bladders are filled with the same or with different pressures based upon a position of each of said at least three of gas-filled bladders of said cushioned ankle holder.

8. The cushioned ankle holder for an inversion table according to claim 1, wherein said at least one gas-filled bladder is retained within said cosmetic skin.

9. The cushioned ankle holder for an inversion table according to claim 1, further includes a plate that retains said cord or string within said at least one slot in said structural support frame.

10. The cushioned ankle holder for an inversion table according to claim 1, wherein said structural support frame is further secured to a cross tube.

11. The cushioned ankle holder for an inversion table according to claim 10, wherein said cross tube has an elongated hole.

12. The cushioned ankle holder for an inversion table according to claim 11, wherein said elongated hole allows said structural support frame to pivot on said cross tube.

13. The cushioned ankle holder for an inversion table according to claim 10, wherein said cross tube is secured to said opening and closing mechanism through a slotted hole.

14. The cushioned ankle holder for an inversion table according to claim 13, wherein said slotted hole allows said structural support frame to pivot on said cross tube.

15. The cushioned ankle holder for an inversion table according to claim 1, wherein said opening and closing mechanism is a control rod that locks at least one gas-filled bladder relative to a fixed stationary heel cup.

16. The cushioned ankle holder for an inversion table according to claim 1, wherein said opening and closing mechanism is a ratchet that moves and locks at least one gas-filled bladder relative to a fixed stationary heel cup.

17. A cushioned ankle holder for an inversion table comprising:

at least one gas-filled bladder that is connected to a flexible backing;

said flexible backing being configured to contour to a structural support frame;

a cosmetic skin that covers said at least one gas-filled bladder;

said cosmetic skin has a cord or string that is captured within a peripheral sleeve of said cosmetic skin;

said cord or string is a draw string that is configured to gather said cosmetic skin around said at least one gas-filled bladder and said structural support frame, wherein said structural support frame includes at least one slot that captures said cord or string, wherein the cord or string is held within the slot by friction;

said structural support frame is connected to an ankle retaining opening and closing mechanism on an inversion table.

18. The cushioned ankle holder for an inversion table according to claim 17, wherein said at least one gas-filled bladder includes a tube whereby gas is transferrable between at least two gas-filled bladders.

19. A cushioned ankle holder for an inversion table comprising:

at least one gas-filled bladder that is configured to contour to a support frame;

a cosmetic skin that covers said at least one gas-filled bladder;

said cosmetic skin has a cord or string that is captured within a peripheral sleeve of said cosmetic skin;

said cord or string is a draw string that is configured to gather said cosmetic skin around said at least one gas-filled bladder and said structural support frame, wherein said structural support frame includes at least one slot that captures said cord or string, wherein the cord or string is held within the slot by friction;

said frame is connected to an ankle retaining opening and closing mechanism on an inversion table.

20. The cushioned ankle holder for an inversion table according to claim 19, wherein said at least one gas-filled bladder includes a tube whereby gas is transferrable between at least two gas-filled bladders.

* * * * *